US007823816B2

(12) United States Patent
Jensen

(10) Patent No.: US 7,823,816 B2
(45) **Date of Patent: *Nov. 2, 2010**

(54) SHREDDER WITH LIGHT EMITTING DIODE (LED) SENSORS

(75) Inventor: Michael D. Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 114 days.

This patent is subject to a terminal disclaimer.

(21) Appl. No.: 12/355,589

(22) Filed: Jan. 16, 2009

(65) Prior Publication Data

US 2010/0090039 A1 Apr. 15, 2010

Related U.S. Application Data

(63) Continuation-in-part of application No. 12/252,158, filed on Oct. 15, 2008.

(51) Int. Cl.
*B02C 4/32* (2006.01)
*B02C 7/14* (2006.01)

(52) U.S. Cl. ..... 241/36; 241/37.5; 241/100; 241/236

(58) Field of Classification Search ..... 241/36, 241/37.5, 100, 236
See application file for complete search history.

(56) References Cited

U.S. PATENT DOCUMENTS 3,882,770 A 5/1975 Bleasdale
4,650,128 A 3/1987 Goldhammer
5,039,020 A * 8/1991 Leuthold et al. ..... 241/30
5,102,057 A 4/1992 Ellis, III
5,167,374 A 12/1992 Strohmeyer
5,318,229 A 6/1994 Brown
5,342,582 A * 8/1994 Horn et al. ..... 422/105
5,375,781 A 12/1994 Schwelling
5,464,162 A 11/1995 Kusters (Continued)

FOREIGN PATENT DOCUMENTS

DE 100 32 069 A1 2/2002

(Continued)

OTHER PUBLICATIONS

British Search Report for Great Britain Patent Applicatin No. GB0917581.1, mailed on Jan. 8, 2010.

(Continued)

*Primary Examiner*—Bena Miller
(74) *Attorney, Agent, or Firm*—Pillsbury Winthrop Shaw Pittman LLP

(57) ABSTRACT

Disclosed herein is a shredder having a throat for receiving at least one article to be shredded therethrough and a shredder mechanism received in a shredder housing which is driven to shred the at least one article fed therein. At least one light-emitting diode (LED) acts as a sensor by emitting and detecting radiation when operated in a forward-biased and reverse-biased direction. The LED(s) may be used to detect the presence of the at least one article in the throat or an amount of shredded particles in a bin. The LED(s) communicate with a controller to operate the shredder mechanism. The controller may also calibrate an intensity of the radiation to or within a predetermined amount above a minimum level in order to reduce wear and run-on conditions.

21 Claims, 8 Drawing Sheets

U.S. PATENT DOCUMENTS

| | | | |
|---|---|---|---|
| 5,897,065 | A | 4/1999 | Schwelling |
| 5,934,584 | A | 8/1999 | Schwelling |
| 6,978,954 | B2 | 12/2005 | Kroger |
| 7,040,559 | B2 | 5/2006 | Matlin |
| 7,204,441 | B1 | 4/2007 | Hartnett |
| 2007/0221768 | A1 | 9/2007 | Wang |
| 2007/0267525 | A1 | 11/2007 | Wang |
| 2010/0176229 | A1 | 7/2010 | Huang et al. |

FOREIGN PATENT DOCUMENTS

| | | | |
|---|---|---|---|
| JP | 2-303550 | | 12/1990 |
| JP | H2-303550 | A | 12/1990 |
| JP | 2002-85994 | | 10/2002 |
| KR | 20050123006 | A | 12/2005 |
| KR | 1020040048706 | A | 12/2005 |

OTHER PUBLICATIONS

Multi-Touch Sensing through LED Matrix Displays, Video on website http://cs.nyu.edu/~jhan/ledtouch/indes.html, Dec. 2, 2008.

Dietz et al., "Very Low-cost Sensing and Communication Using Bidirectional LEDs", Mitsubishi Electric Research Laboratories, Cambridge, Massachussetts.

Gadre et al., "LED Senses and Displays Ambient Light Intensity", Sep. 14, 20063 pages.

Motestruments!, Internet search; http://web.archive.org.web/20060604000250/http:/motestruments.com/led-touch-sensor-circuit/, Dec. 18, 2008, 3 pages.

Kyle Holland, "LED doubles as emitter and detector", EDN, Aug. 16, 2001, 2 pages.

Gadre et al., "LED senses and displays ambient-light intensity", article from Internet: http://www.edn.com/index.asp?layout=article&articleid=CA6387024, Jul. 22, 2008, 4 pages.

JustDIY Project Log, Internet search: http://projects.dimension-x.net/technology-and-projects/ledsensors; Jul. 29, 2008, 3 pages.

* cited by examiner

SHREDDER WITH LIGHT EMITTING DIODE (LED) SENSORS

RELATED APPLICATION(S)

This application is a continuation-in-part of U.S. patent application Ser. No. 12/252,158, filed Oct. 15, 2008, which is incorporated herein by reference in its entirety, and claims priority thereto.

BACKGROUND

1. Field of Invention

The present invention is generally related to a shredder having at least one light-emitting diode (LED) acting as an emitter and detector to assist in determining an operation of cutter elements for shredding articles.

2. Background

A common type of shredder has a shredder mechanism contained within a housing and mounted atop a container. The shredder mechanism typically includes a cutting head assembly including a series of cutter elements that shred articles such as paper, CDs, DVDs, credit cards, and the like that are fed therein and discharge the shredded articles downwardly into the container. An example of such a shredder may be found, for example, in U.S. Pat. No. 7,040,559, which is herein incorporated by reference in its entirety.

When users feed articles into the shredder mechanism, a sensor may be provided to detect the presence of such articles, thereby activating the shredder mechanism to shred the articles. One or more sensors may also be provided to detect if the container is full of shredded articles. Optical sensors are commonly used because they have no moving parts. However, the optical sensors used in shredders preferably have a wide range of electrical characteristics and/or sensitivities to detect the wide range of articles and media (e.g., articles of various colors, materials), without providing any false positive signals for activating the shredder mechanism during the life of the sensor. For example, the drive signal of the sensor must provide an intensity of light that is sensitive to detect both paper and CDs and/or shredded articles.

Typical examples of optical sensors include those which have discrete components for emitting and for detecting light or radiation, such as an infrared (IR) beam. Such sensors require that the beam be interrupted (i.e., broken) between the emitter and detector to sense a condition. Alternatively, reflective-types sensors may be used (e.g., which detect reflected light or beams), which may use a simple assembly rather than discrete components. However, improvements in cost, assembly, and construction of sensors that are used in shredders would be beneficial.

SUMMARY OF THE INVENTION

One aspect of the invention provides a shredder including a shredder housing having a throat for receiving at least one article to be shredded therethrough and a shredder mechanism received in the housing. The shredder mechanism includes a motor and cutter elements, and enables the at least one article to be shredded to be fed into the cutter elements. The motor is operable to drive the cutter elements in a shredding direction so that the cutter elements shred the at least one article fed therein into particles. The shredder also includes at least one light-emitting diode being operable as a sensor. The at least one light-emitting diode sensor is configured to be used as an emitter when operated in a forward-biased direction and configured to be used as a detector when operated in a reverse-biased direction. A controller is coupled to the sensor and the shredder mechanism, and is configured to alternate an input to the light-emitting diode between the forward-biased and reverse-biased directions. The controller is also operable to control an operation of the shredder mechanism based upon the radiation detected by the sensor.

Another aspect of the invention includes a shredder includes a shredder housing having a throat for receiving at least one article to be shredded therethrough, and a shredder mechanism received in the housing. The shredder mechanism includes a motor and cutter elements, and enables the at least one article to be shredded to be fed into the cutter elements. The motor is operable to drive the cutter elements in a shredding direction so that the cutter elements shred the at least one article fed therein into particles. The shredder also includes a container for receiving shredded particles. A series of light-emitting diodes are provided in the shredder and are positioned to receive radiation reflected off of the shredded particles deposited in the container and determine an intensity of the reflected radiation. The intensity corresponds to an amount of shredded particles deposited in the bin. Also, the series of light-emitting diodes are configured to be used as emitters when operated in a forward-biased direction and configured to be used as detectors when operated in a reverse-biased direction. A controller is coupled to the series of light-emitting diodes and the shredder mechanism, and configured to alternate an input to the series of light-emitting diodes between the forward-bias and reverse-biased directions. The controller is operable to control an operation of the shredder mechanism upon detection by the sensor.

Yet another aspect of the invention provides a method performed in a shredder including a shredder housing having a throat for receiving at least one article to be shredded therethrough, and a shredder mechanism received in the housing. The shredder mechanism includes a motor and cutter elements, and enables the at least one article to be shredded to be fed into the cutter elements. The motor is operable to drive the cutter elements in a shredding direction so that the cutter elements shred the at least one article fed therein into shredded particles. The shredder also includes at least one light-emitting diode being operable as a sensor, the at least one light-emitting diode sensor configured to be used as an emitter when operated in a forward-biased direction and configured to be used as a detector when operated in a reverse-biased direction. A controller is coupled to the sensor and the shredder mechanism, and is configure d to alternate an input to the light-emitting diode between the forward-biased and reverse-biased directions. The controller is operable to control an operation of the shredder mechanism based upon the radiation detected by the sensor. The method includes: alternating the input to the light emitting diode between the forward-biased and reverse-biased directions; detecting reflected radiation with the light-emitting diode; and controlling, with the controller, an operation of the shredder mechanism based upon the radiation detected by the light-emitting diode.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

The following embodiments are described with reference to the drawings and are not to be limiting in their scope in any manner.

Figure 1:
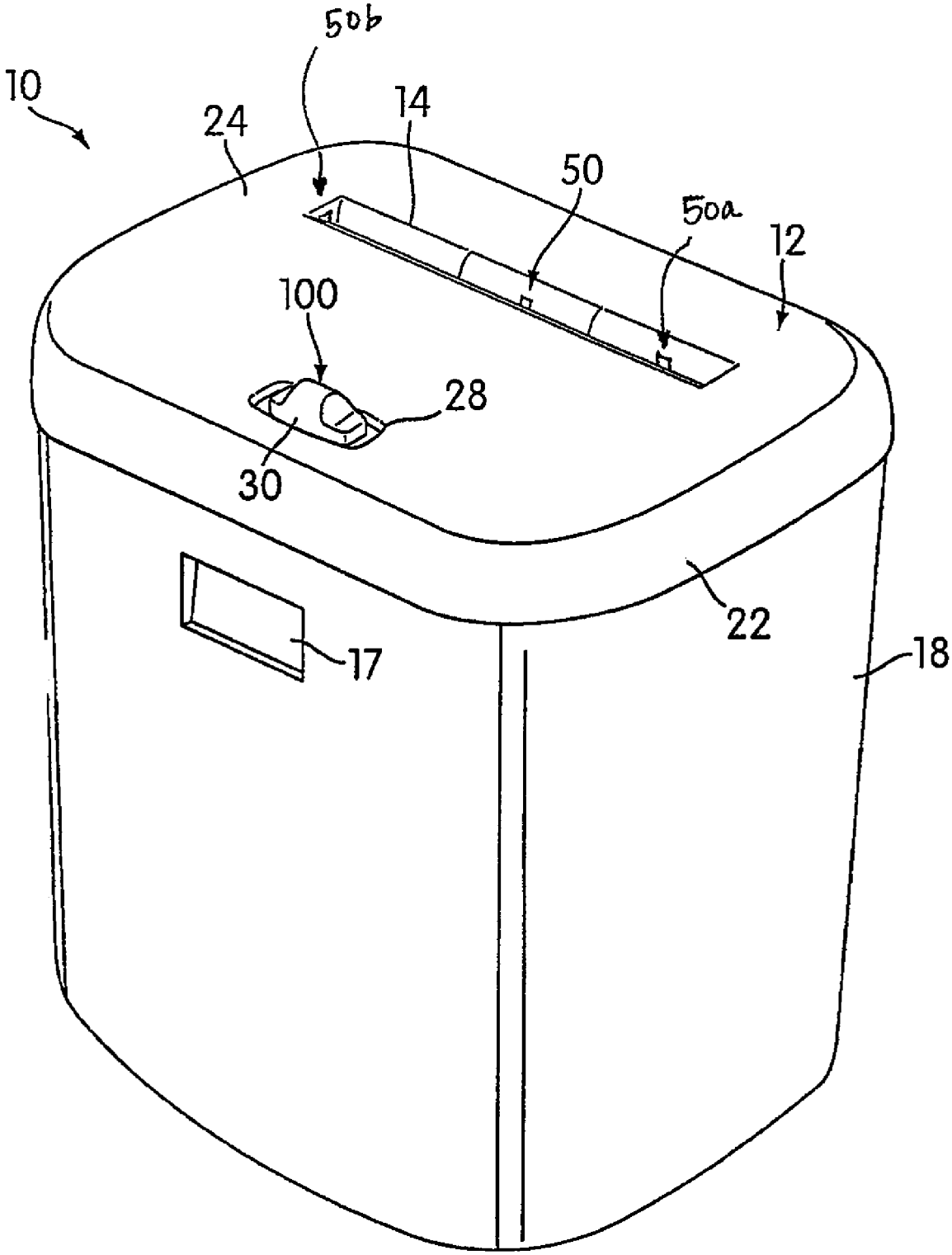
FIG. 1 is a top perspective view of a shredder apparatus including at least one sensing device constructed in accordance with an embodiment of the present invention.

FIG. 1 is a top perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise wheels (not shown) to assist in moving the shredder 10. The shredder 10 comprises a shredder housing 12 that sits on top of a container 18, for example.

Figure 2:
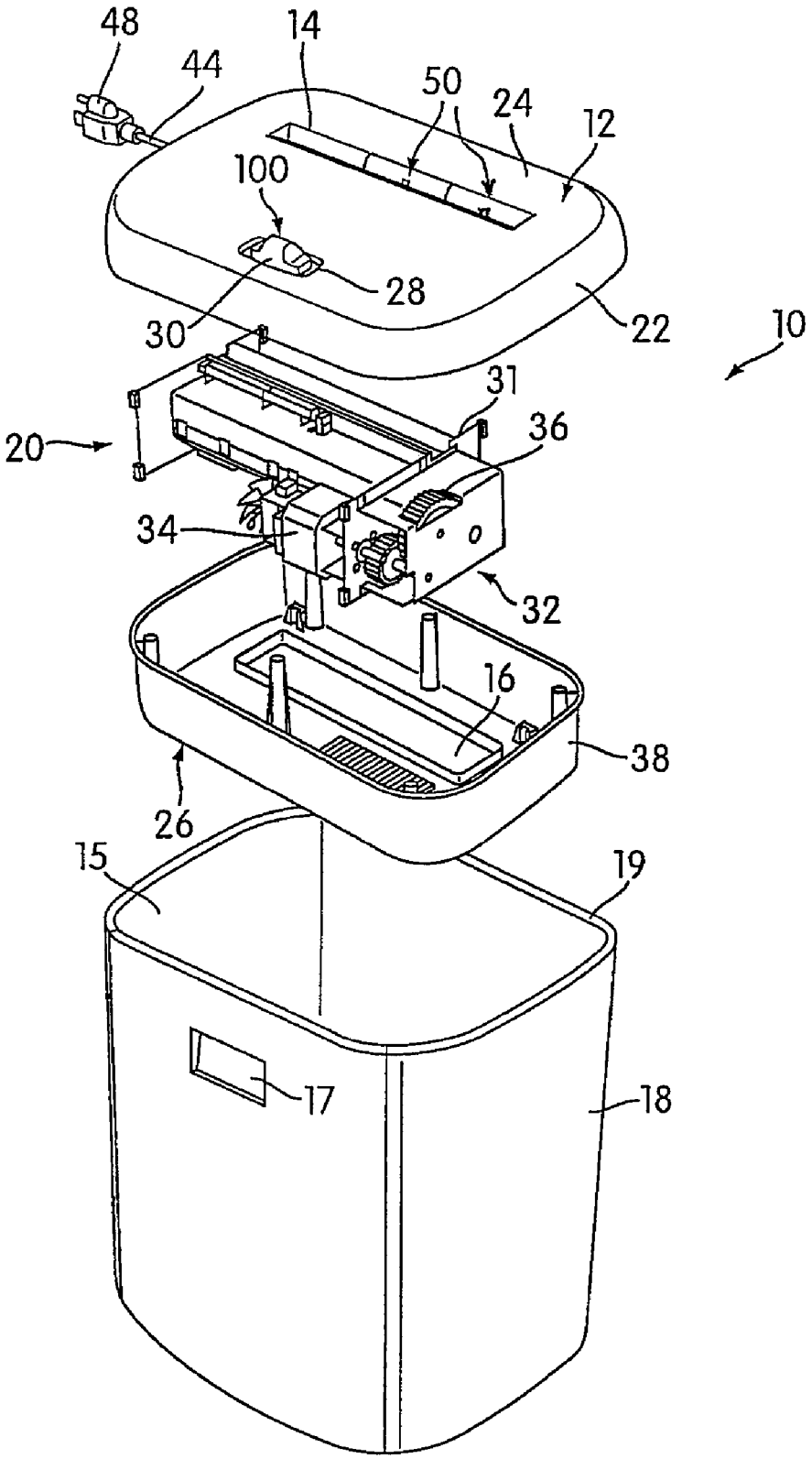
FIG. 2 is an exploded perspective view of FIG. 1.

The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. In an embodiment, an additional or second input opening (not shown) may be provided in shredder housing 12. For example, input opening 14 may be provided to receive paper, paper products, and other items, while second input opening (not shown) may be provided to receive objects such as CDs and DVDs. Shredder housing 12 also comprises an output opening 16 on a lower side 26 (or bottom side or bottom wall or underside or bin side), such as shown in FIG. 2. In an embodiment, shredder housing 12 may include a bottom receptacle 38 with lower side 26 to receive shredder mechanism 20 therein. Bottom receptacle 38 is affixed to the underside of the upper side. 24 or top wall base fasteners, for example. The receptacle 38 has output opening 16 in its bottom side 26 or bottom wall through which shredded particles are discharged.

Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As noted, the shredder 10 also comprises a shredder mechanism 20 (shown generally in FIG. 2) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. Shredder mechanism 20 includes a drive system 32 (generally shown in FIG. 2) with at least one motor 34, such as an electrically powered motor, and a plurality of cutter elements 21 (see FIG. 3). The cutter elements 21 are mounted on a pair of parallel mounting shafts (not shown). The motor 34 operates using electrical power to rotatably drive first and second rotatable shafts of the shredder mechanism 20 and their corresponding cutter elements 21 through a conventional transmission 36 so that the cutter elements 21 shred or destroy materials or articles fed therein, and, subsequently, deposit the shredded materials into opening 15 of container 18 via the output opening 16. The shredder mechanism 20 may also include a sub-frame 31 for mounting the shafts, motor, and transmission in the housing 12, for example. The drive system may have any number of motors and may include one or more transmissions. Also, the plurality of cutter elements 21 are mounted on the first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Shredder housing 12 is configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used to support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening, handle, or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 24 of the shredder housing 12, for example, or anywhere else on the shredder 10. The upper side 24 may have a switch recess 28 with an opening therethrough. An on/off switch 100 includes a switch module (not shown) mounted to housing 12 underneath the recess 28 by fastening devices, and a manually engageable portion 30 that moves laterally within recess 28. The switch module has a movable element (not shown) that connects to the manually engageable portion 30 to move the switch module between its states. Movement of the manually engageable portion of switch 100 moves the switch module between states. In the illustrated embodiment shown in FIG. 2, the switch module connects the motor 34 to the power supply. This connection may be direct or indirect, such as a connection via a controller 56 (shown in FIG. 6). The term "controller" is used to define a device or microcontroller having a central processing unit (CPU) and input/output devices that are used to monitor parameters from devices that are operatively coupled to the controller. The input/output devices also permit the CPU to communicate and control the devices (e.g., such as a sensor 50 or the motor 34) that are operatively coupled to the controller. As is generally known in the art, the controller may optionally include any number of storage media such as memory or storage for monitoring or controlling the sensors coupled to the controller.

Figure 6:
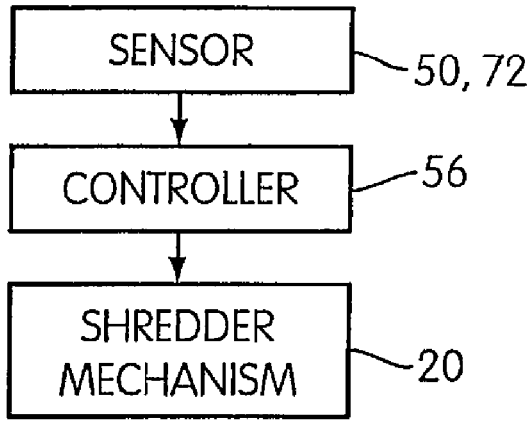
FIG. 6 is a schematic illustration of interaction between a controller and other parts of the shredder in accordance with an embodiment of the present invention.

The controller 56 likewise communicates with the motor 34 of the shredder mechanism 20 (shown schematically in FIG. 6). When the switch 100 is moved to an on position, the controller 56 can send an electrical signal to the drive of the motor 34 so that it rotates the cutting elements 21 of the shredder mechanism 20 in a shredding direction, thus enabling paper sheets to be fed in the throat 14 to be shredded. Additionally or alternatively, when the switch 100 is in an on position, the switch 100 may be set to an idle or ready position, which communicates with the control panel. The idle or ready position may correspond to selectively activating the shredder mechanism 20, for example. As will be further described below, the controller 56 may selectively enable the operation of the shredder mechanism 20 based on the detection of the presence or insertion of at least one article (e.g., paper) in the throat 14 by a sensor 50, such as an activation sensor. Also, in an embodiment, the controller 56 may selectively enable the operation of shredder mechanism 20 based on the detection of shredded particles accumulating in the container or bin 18 by a sensor 72, such as a waste level or bin full sensor. The switch 100 may also be moved to an off position, which causes the controller 56 to stop operation of the motor 34.

The switch module contains appropriate contacts for signaling the position of the switch's manually engageable portion. As an option, the switch 100 may also have a reverse position that signals the controller 56 to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 100 may be a sliding switch, a rotary switch, or a rocker switch. Also, the switch 100 may be of the push switch type that is simply depressed to cycle the controller 56 through a plurality of conditions. Additionally, the controller 56 may determine that throat 14 (e.g., via one or more sensors 50) is not clear of articles, and, thus, operate the motor 34 in a reverse direction (e.g., for a short period of time) so as to clear any remaining articles (or parts thereof) from the throat 14 of the shredder 10.

Generally, the construction and operation of the switch 100 and controller 56 for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller by the operation of the switch. Any of the conditions could also be signaled by lights, on a display screen, or otherwise.

As noted, shredder 10 may have one or more activation sensors 50 and/or one or more waste level or bin full sensors 72. Activation sensor 50 emits and detects radiation and is operable to detect the presence or insertion of at least one article based a change in the radiation detected by the sensor. In some cases, such a detected change may be caused by an article being inserted into the throat. As will be further described, the one or more activation sensor(s) 50 may be single, dual-function device for emitting and detecting radiation, such as a light-emitting diode or LED. Alternatively, the activation sensor comprises a plurality of LEDs. Radiation may include, but not be limited to, visible light, infrared (IR) light, and ultraviolet light, or any combination thereof.

As shown in FIG. 1, one or more activation sensor(s) 50 may be located within the throat 14. For example, a sensor 50 may be located below the upper wall 24 and above the cutter elements 21 of shredder mechanism 20. However, the location of the sensor(s) 50 should not be limited. The sensor 50 may be provided in any number of locations in relation to shredder housing 12 or shredder mechanism 20. For example, one or more activation sensors 50*a* and/or 50*b* for detecting the presence of the at least one article to be shredded may be provided in alternate locations in, around, near, or adjacent the throat 14. In some embodiments, activation sensor 50*a* may be provided near a right or left side of the throat 14, for example. In some embodiments, activation sensor 50*b* may be provided on or near an end of the throat 14. In addition, a plurality of sensors (e.g., in the center, below the entrance, on the side, on an end) may be provided in, around, near, or adjacent the throat 14 and are envisioned. Additionally, activation sensor(s) 50 may be provided in a location above cutter elements 21 in shredder mechanism 20. In some instances, components could also be mounted facing each other, much like existing emitter and receiver sensors. For example, the LEDs may be mounted in such a way if it is desirable to determine if there is a distinct change in state (e.g., blocked/unblocked) when an article or paper is inserted into the throat 14.

Activation sensor(s) 50 are operatively connected to the shredder mechanism 20. For example, when the sensor 50 senses that an article is present in the throat 14, the shredder mechanism 20 is activated to shred the article. However, when the sensor 50 determines that no article is present in the throat, the shredder mechanism 20 becomes inoperable. Specifically, the activation sensor(s) 50 will communicate with controller 56 to disable power to the shredder motor 34 (e.g., via opening a switch to disable power from being sent to the motor 34) when no article is detected as being present in the throat 14.

Assuming that the switch 100 is in an on (or idle) position, for example, the controller 56 enables operation of the shredder mechanism 20 by activating the motor 34 to drive the cutter elements 21 in a shredding direction when paper or an article is inserted in the throat 14. The use of an activation sensor 50 is desirable because it allows the user to ready the shredder 10 by moving the switch 100 to its on position, but the controller 56 will not operate the shredder mechanism 20 to commence shredding until the sensor 50 detects the presence or insertion of one ore more articles in the throat 14. Once the at least one article has passed into the shredder mechanism 20 beyond the activation sensor 50, the controller 56 will then stop the movement or rotation of the cutter elements 21 of shredding mechanism 20, as that corresponds to the articles having been fully fed and shredded. Typically, a slight delay in time, such as 3-5 seconds, is used before stopping the shredder mechanism 20 to ensure that the articles have been completely shredded by the cutter elements 21 and discharged from the shredder mechanism 20. The use of such an activation sensor 50 is beneficial because it allows the user to perform multiple shredding tasks without having the shredder mechanism 20 operating, making noise, between tasks. It also reduces wear on the shredder mechanism 20, as it will only operate when substrates are fed therein, and will not continually operate. Further description regarding how the LED of the activation sensor 50 determines the presence of an article is provided with respect to FIGS. 5*a*-5*c*.

Figure 3:
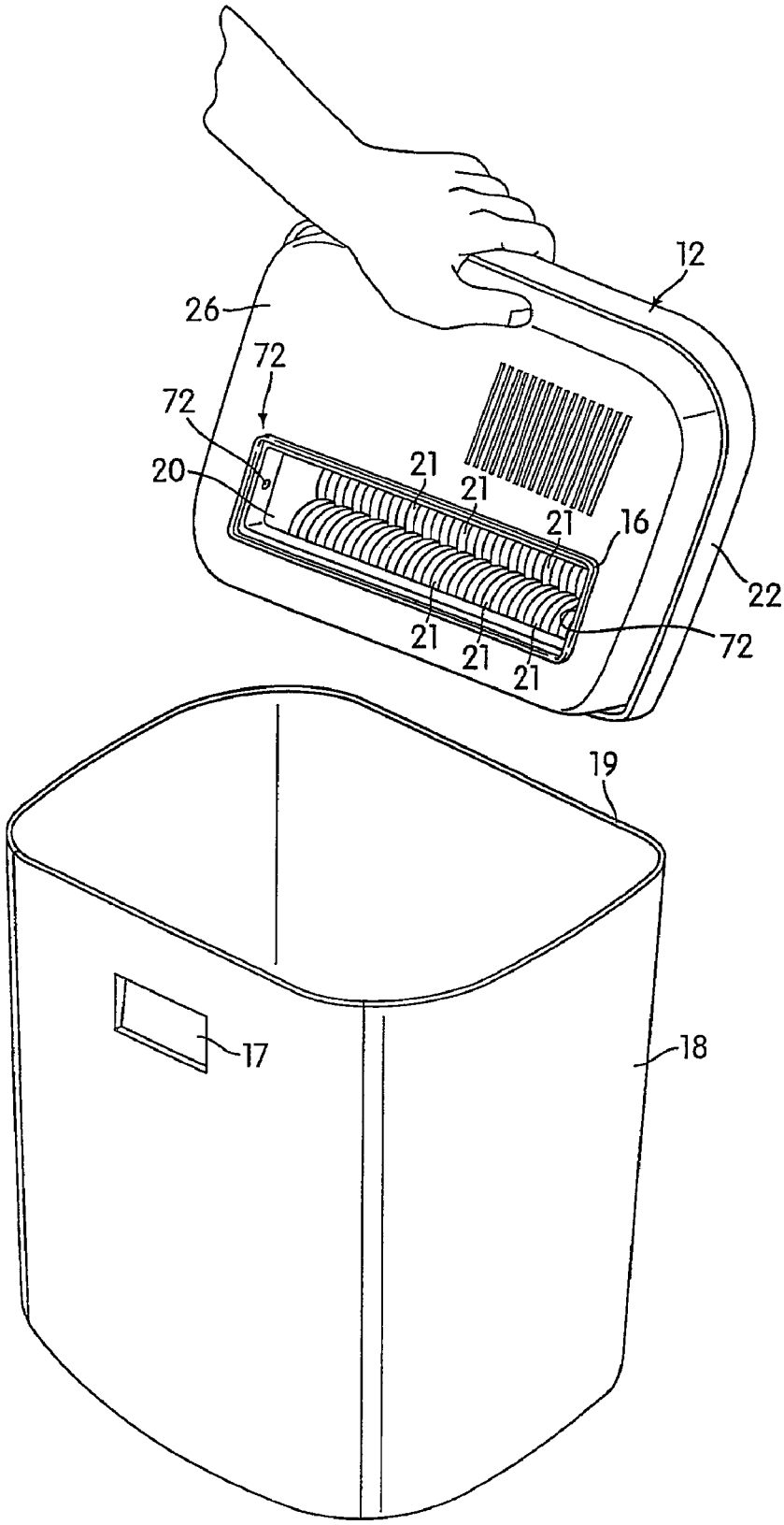
FIG. 3 is a detailed perspective view of a lower side of a shredder housing of a shredder apparatus including at least one sensing device in accordance with an embodiment of the present invention.
Figure 4:
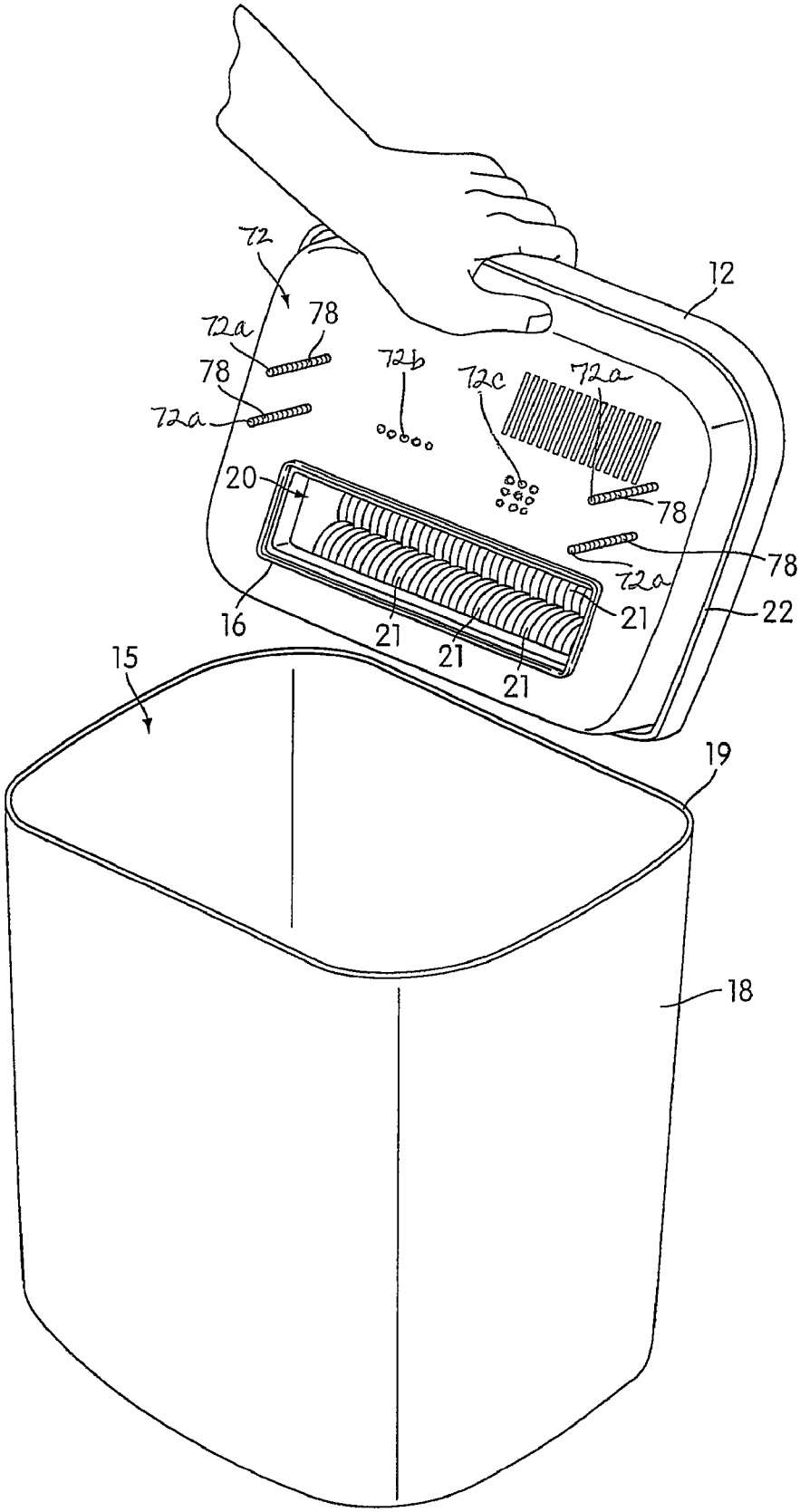
FIG. 4 is a detailed perspective view of a lower side of a shredder housing of a shredder apparatus including one or more sensors in accordance with an embodiment of the present invention.

In some embodiments, shredder 10 may comprise one or more waste level or bin full sensing device 72, such as shown in FIGS. 3 and 4. The waste level sensor(s) 72 also comprise a single device for emitting and detecting radiation. The waste level sensor(s) 72 comprise one or more light-emitting diodes (LEDs). The radiation emitted by the sensor 72 may include light in the visible spectrum, infrared radiation, and/or ultraviolet radiation. Shredded particles being discharged by the shredder mechanism 20 and accumulated in the container or bin 18 will be detected by the sensing device(s) 72. The LED sensors 72 may be located in a number of locations in the shredder 10. For example, in some embodiments, shredder 10 may comprise one or more sensing devices 72 as shown in FIGS. 3 and 4. The LED sensing devices 72 are positioned to emit and detect radiation with respect to the bin or container 18. In some embodiments, a plurality of sensors 72 or a series of LEDs may be arranged in a spaced apart relation. Generally, any number of LED sensing devices 72 may be provided, and mounted in several ways, and therefore should not be limiting.

More specifically, one or more waste level/bin full LED sensing devices 72 may be provided on the bottom wall or lower side 26 of the shredder housing 12. In some embodiments, the sensing device(s) 72 may be provided near or adjacent the output opening 16 or throat 14, such as depicted in FIG. 3. For example, it is envisioned that in an embodiment one or more sensing devices 72 may be mounted or provided in a manner such as is disclosed in U.S. patent application Ser. No. 12/184,631, filed Aug. 1, 2008, and assigned to the same assignee, which is hereby incorporated by reference in its entirety. In some embodiments, the one or more sensors 72 mounted to the lower side 26 of housing 12 are flush with the bottom wall of the lower side 26. In some embodiments, one or more sensors 72a are provided on structures 78 extending downwardly from the bottom wall or lower side 26, as shown in FIG. 4. In some cases, for example, as illustrated in FIG. 4, a plurality of LED sensors 72 are provided in an array or a series, such as in a horizontal row, such as represented by 72*b*, or a series of rows or a shape, such as represented by 72*c*.

When a plurality of sensors 72 are provided, the components may be mounted next to each other in relatively close proximity. In some instances, the proximity may depend upon the distance to be detected (e.g., the distance from the sensor to a bottom of the container 18), and/or the characteristics of the LED itself (e.g., viewing angle, light intensity, etc.). When the LED sensors 72 are mounted in such a manner, the components are able to work together (e.g., see radiation or light from other LEDs). In some instances, the components could also be mounted facing each other, much like existing emitter and receiver sensors. For example, the LEDs may be mounted in such a way if it is desirable to determine if there is a distinct change in state (e.g., blocked/unblocked).

Alternatively, although not shown, the sensors 72 may be mounted on one or more side walls of the container 18 or in any other manner so as to emit radiation into the container 18. In some embodiments, the sensing device(s) 72 may be provided on one or more side walls of the container 18, such as near lip 19, for example. Thus, the location or mounting of the sensing device(s) 72 should not be limiting, such that the configuration allows the sensor(s) 72 to sense shredded particles entering the waste opening of the bin 18 or that are accumulating therewithin.

The sensing device(s) 72, no matter their location, are used to determine if a bin or container 18 is accumulating or is full of shredded particles. Waste level or bin full sensor(s) 72 are also operatively connected to the shredder mechanism 20. For example, as a user shreds articles, shredded particles are discharged by the shredder mechanism 20 through opening 16 (e.g., into container 18). As the shredded particles build up, the sensing device(s) 72 may detect the accumulation or level of shredded particles in the container 18 and thus warn the user or, alternatively, detect that the container 18 is full and thus communicate with the controller 56 to stop operation of the shredder mechanism 20 until the container 18 is at least partially emptied. Further description regarding how the LED of the waste level or bin full sensing device 72 determines accumulation of shredded particles is further described with respect to FIGS. 5*a*-5*c*.

Assuming that the switch 100 is in an on (or idle) position, for example, the controller 56 controls the operation of the shredder mechanism 20 by activating or deactivating the motor 34 for driving the cutter elements 21, depending on the how full the container 18 is (e.g., using a counting method), or how much accumulated particles are detected (e.g., using the height of a pile, for example). The use of waste level/bin full sensor(s) 72 are desirable because the controller 56 will not operate the shredder mechanism 20 when the sensor(s) 72 detect that the accumulation of shredded particles nearly or substantially fills the bin 18. This is beneficial because it also reduces wear on the shredder mechanism 20, as well as assists in preventing potential jamming in the shredder mechanism or output opening 16, as it will only operate when the bin is not full of accumulated particles.

The activation sensor(s) 50 and waste level sensor(s) 72 in the shredder 10 as described above are single, dual-function devices. As single, dual-function devices, they are capable of emitting and detection radiation. For example, sensors 50 and 72 are LED sensors. A light emitting diode (LED) is an example of a source that may be used for light, and/or for acting as an emitter and a detector, for example. Generally, LEDs or single devices may act as sensing devices by alternating between operating in a forward bias mode to emit radiation and a reverse bias mode to detect radiation because of their bipolar characteristics.

Figures 5A, 5B, 5C:
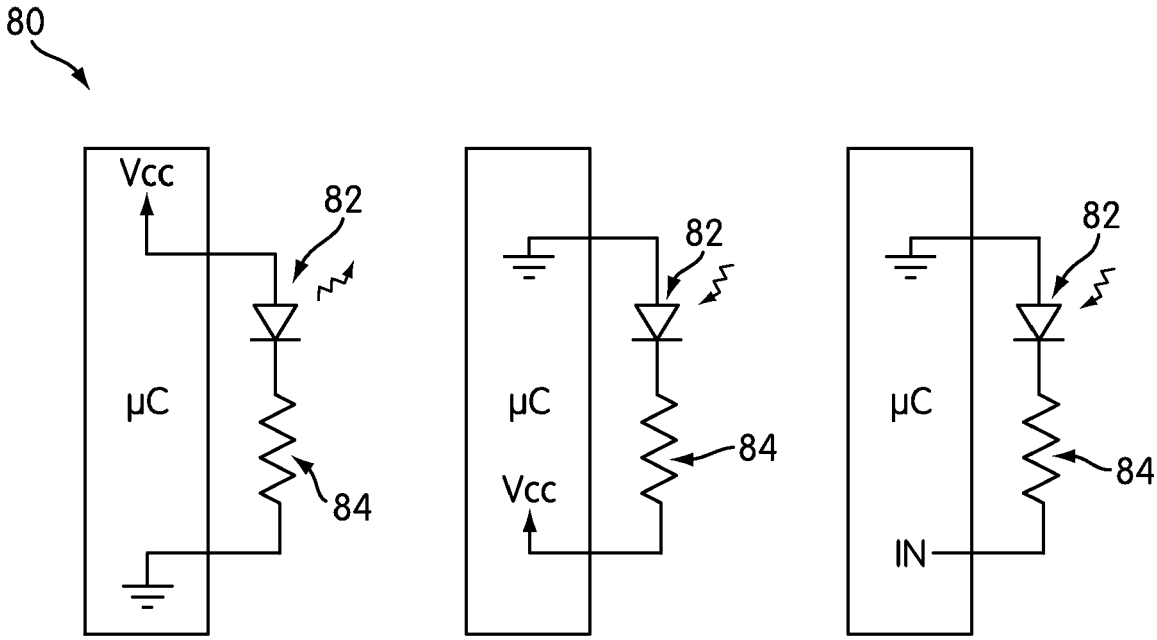
FIGS. 5*a*-5*c* illustrate circuit diagrams showing steps for emitting and detecting radiation using a light-emitting diode as a sensor in accordance with an embodiment of the present invention.

FIGS. 5*a*-5*c* illustrate circuit diagrams 80 showing steps for emitting and detecting radiation using a light-emitting diode (LED) as sensor(s) 50 or 72. The circuit diagrams of FIGS. 5*a*-5*c* are replicated from the Publication "Very Low-Cost Sensing and Communication Using Bidirectional LEDs," by Dietz et al. for Mitsubishi Electric Research Laboratories, ©2003. The circuit 80 is connected to a microcontroller, such as controller 56, for example. Controller 56 may take appropriate action in response to signal levels detected by the LED, or enable/disable delivery of power to the LED element. The circuit 80 may include a voltage supply Vcc, light emitting diode 82, resistor 84, and circuit ground connected in series. The resistor 84 is optional and need not be provided, however. Also, although a single diode is shown, one or more diodes, such as an array or series of LEDs, may be provided to help provide consistency as well as increase the sensing area. Configuring the use of the circuit 80 as shown allows a single component (LED 82) to serve as a dual purpose device. The pins or leads of the LED, also referred to as the anode and cathode, are connected to the pins of the microcontroller.

The general principles of operation of the circuit 80 will be readily understood by those in the art. To take advantage of the photo-sensitive and bipolar properties provided by one or more LEDs (visible light or IR) such that one or more LEDs may serve as both emitters and detectors, i.e., single, dual-functioning devices 50 and/or 72, the LED is first forward-biased to turn the LED on, i.e., emit light and act as an emitter, as shown in FIG. 5*a*. After a predetermined amount of time, the level of the pins of the microcontroller are inverted. The predetermined amount of time for inverting the pins may include any amount of time and should not be limiting. Thus, the LED is reverse-biased, as shown in FIG. 5*b*. This allows the LED to act as a light sensor or detector. As will be understood by those skilled in the art, the LED builds a charge and acts as a light dependent capacitor during this phase. That is, the LED acts as a capacitive sensor in that it detects the presence of objects (e.g., an article, document, shredded particles, and others) without requiring physical contact. Thus, when an article or shredded particles move near or close to LED sensors 50 or 72, there is an increase in capacitance. This increase in capacitance may cause the LED to indicate (and thus communicate with the controller 56) the presence of an article in the throat 14 or accumulated shredded particles in bin 18.

After another pre-determined amount of time, the cathode side of the LED is turned to an input, as shown in FIG. 5*c*. Again, the amount of time should not be limiting. The rate of discharge through the RC network (i.e., the LED) is directly proportional to the amount of light the sensor is exposed to. The LEDs are responsive to light of a similar frequency to the light they emit when forward biased.

Thus, the LED sensing devices 72 as described herein are designed to detect changes in light intensity. In cases where LEDs are part of an array or series, the LEDs may be detecting changes in light intensity based on sensing reflected radiation emitted from the other LED devices (e.g., in its proximity). If, however, an LED is not provided in an array or series, the LED may provide several functions. In some cases, a single LED may determine an amount of ambient light, and thus a detected change in intensity determined by the LED may correlate to that of an object (e.g., shredded particles) blocking ambient light from it. Generally, the closer an object gets to an LED, the less ambient light the LED detects. In such a case, a single LED may act as a user indication device when emitting radiation. Referring to FIG. 1, for example, activation sensor 50 may be a single LED device for indicating to a user a location for insertion of an article. A single LED may also be provided to emit light when the shredder is available or ready for use, as a guide for increasing visibility, or when it is operating. Thus, the LED device is emits light to attract the user and as a functional indicator.

For example, the LED may be used as a dual-function throat sensor that works as both a detector for detecting an article and a user indicator. That is, the sensor is mounted to the throat so at least a portion thereof is viewable externally of the shredder (i.e., by a user looking at it). The alternating input to the light-emitting diode causes the diode to emit radiation and act as a user indicator in the forward-biased direction, thus indicating that the shredder is on and ready for use, for example. The diode also functions as the detector in the reverse-biased direction that detects insertion of the at least one article based on a change in the ambient light. In some embodiments, the rate at which the diode is alternated between the forward-biased and reverse-biased directions may be sufficiently high (or fast) that the change between emission and detection is undetectable by the human eye. In some embodiments, the diode may blink. The blinking may occur because the diode input is alternating between forward and reverse-bias, thus providing a blinking effect. In any case, the LED alternates between the bipolar states at a determined rate. Also, it should be noted that the indicating function of an LED should not be limiting.

In some cases, a single LED may be provided to act as a photodetector, thereby detecting the lack of ambient light.

It should be noted that, although in some cases some residual charge may be left over from the charge/discharge cycle (i.e., forward biasing and reverse biasing as provided in FIGS. 5*a*-5*c*), which may vary and is dependent on the amount of radiation detected, the residual charge does not cause major changes in the electrical characteristics of the LEDs.

By manipulating the LEDs such that they may act as capacitive sensors, one may use LEDs to detect an intensity of radiation, which corresponds to either (a) the presence of an article within the throat 14 or (b) an amount of shredded material deposited in the bin 18. It is important to note the manner in which the sensing devices 50 and 72 determine the presence of an article or a full or substantially full bin. The sensors 50, 72 may use any sort of circuitry, software, logic, computer readable medium, or combination thereof to determine such actions. For example, in the case of an LED activation sensor 50, circuitry and/or logic may be used to note a change in intensity of emitted light (i.e., change in capacitance) is directly proportional to the presence of an article, document, or sheet of paper. That is, if an increase in intensity or capacitance is determined, an article is detected as being present within the throat 14. Alternatively, if the intensity or capacitance decreases, it is determined that an article is not present in the throat 14.

In the case of an LED waste level or bin full sensor 72 (which may comprise one or more LEDs), circuitry and/or logic may be used to note that a change in intensity of emitted light (i.e., change in capacitance) may be directly proportional to the amount of shredded materials in the bin. That is, if a decrease or an increase in capacitance in the LED(s) are determined, a decrease or an increase, respectively, in the amount of shredded materials in the bin 18 is detected. Specifically, an increase in the capacitance of the LEDs (i.e., intensity of the radiation) detected by sensing devices 72 corresponds to an increase in the amount of shredded material deposited in the bin. Alternatively, as the distance between the accumulated shredded particles and the LED sensors 72 decreases, so does the capacitance therebetween decrease. This decrease in capacitance results in a decreased signal level in the sensor/LED.

An advantage of using LED sensing devices 50 and/or 72 includes a reduced cost for the sensors. Using single devices such as LEDs is less costly than other combinations, such as IR/PT combinations or other known devices. Additionally, LED sensing devices simplify the manufacture of a shredder 10 and/or shredder housing 12. For example, in the case of assembling one or more LED activation sensors 50 in the shredder 10, wire management in the shredder housing 12 is simplified in that assembly is defined to one side of the throat 14 (e.g., rather than needing to maneuver and assemble wires on both sides such as is the case when separate emitter(s) and detector(s) are provided). Furthermore, using LED sensing devices improves overall machine quality. In addition, the LED sensing devices appear to be a general LED indicator, thus providing a simple design.

The LED activation sensor 50 may also provide advantages with respect to its sensitivity for detecting paper or other articles which may be inserted into the throat, for example. In some cases, the output of the sensor(s) 50 may be interpreted (e.g., using software) as an analog signal or a pulse width modulated (PWM) digital signal. When using a PWM digital signal, the output is determined based on detected light intensity, which then allows for the sensitivity of the sensor 50 to be adjusted as necessary. This is advantageous because existing auto-start signals are typically digital signals and therefore are more difficult to adjust the sensitivity of the components. Using LEDs as activation sensors 50 allows for adjustment of the sensitivity.

The use of LED sensors such as activation sensors 50 or bin full sensing device 72 are preferably able to consistently detect a wide range of articles and media as well as detect the presence of a single sheet of paper or shredded particles without providing any false positive signals (e.g., from the controller 56 to the motor 34 of the shredder mechanism 20) during the life of the sensor 50 or 72. In some embodiments, the emission of radiation from activation sensor 50 and/or bin full sensing device 72 provides certain levels of intensity (or brightness) of light. However, due to aging, misalignments, variances in tolerances, and/or different sensor grades, the intensity or brightness of the light beam or radiation emitted from the sensors is altered. For example, the intensity of the sensors may decrease due to age and addition of dust or residue on and around the components. A decrease in intensity in indicative of that the sensor's performance is declining. When the perceived intensity of the sensor is reduced, false positive signals may be sent from the controller 56, thus creating a "run-on" condition for the shredder 10. When false positive signals occur with sensors detecting the container being full with shredded articles, the shredder mechanism may not run (or it may run when the bin is full), also causing frustration to users.

In order to compensate for the required characteristics, sensitivities, and other features of the activation sensor 50 or bin full sensing device 72, the intensity of the radiation emitted by the sensor 50 or 72 may be adjusted and modified so that the sensor is capable of detecting such previously described events. For example, using LEDs for sensing devices 50 and/or 72 improves the quality of the machine or device in that it allows for possible self-calibration using methods as noted in the related application U.S. patent application Ser. No. 12/252,158, filed Oct. 15, 2008 and assigned to the same Assignee, which is incorporated by reference in its entirety.

Each LED sensor provided in the shredder 10 may be calibrated to define its zero position. The "zero position" of a sensing device may then be defined as a position the sensor assumes when the shredder 10 is powered on and does not detect an action (e.g., with no articles being present in the throat 14, or with no shredded particles being present in the bin 18 (e.g., no accumulation of shredded particles being detected)). For example, shredded particles being discharged by the shredder mechanism 20 and into the bin 18 will increase the capacitance of the LED sensing device 72. Thus, to set the LED sensor(s) to their corresponding zero position, a calibration or re-calibration to determine such a position, may be performed.

Figure 7:
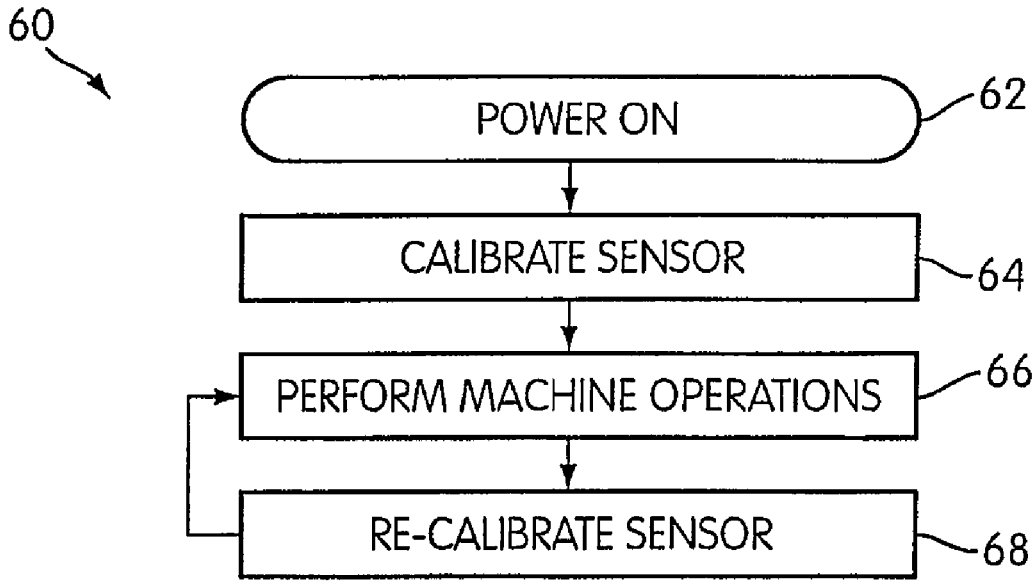
FIG. 7 is a flow chart diagram of a method for calibrating the sensor(s) in accordance with an embodiment of the present invention.

For example, FIG. 7 illustrates a method 60 or cycle for operating a shredder with sensor 50 and/or sensing device 72 in accordance with an embodiment of the present invention. After the shredder is powered on, as represented at 62, the intensity of the radiation from sensor 50 or 72 is calibrated, as represented at 64. Typical machine operations (e.g., shredding) may then be performed, as noted by 66, for at least one article that is inserted into the throat 14 to be shredded. After the operation of the shredder mechanism 20, the intensity of the radiation may be re-calibrated, as represented at 68.

In order to calibrate and/or recalibrate the intensity of the radiation of sensors 50 and/or 72, the controller 56 may provide instructions or signals to sensor 50 and/or 72. For example, the controller 56 may receive a signal to stop the operation of the motor 34, and shortly thereafter perform an automatic calibration of sensor 50 and/or 72. In this case, "automatic" calibration, or automatically performing the method, refers to calibrating the intensity of the radiation after detection (e.g., of paper of shredded particles) by the sensor. In an embodiment, the intensity of the radiation emitted by the sensor is adjusted to or within a predetermined amount above a minimum level detectable by the detector when no article or shredded particles is/are present to change the radiation detected by the sensor, or when no shredded particles are accumulated in the bin 18.

In the case of an activation sensor such as LED sensor 50, the level at which the intensity is preferably set may be generally defined as a threshold detection point at which the sensor is capable of determining in increase in capacitance by the insertion of one or more articles, while still being sensitive to detect a change in the radiation (e.g., caused by one or more sheet(s) of paper), being inserted into the throat 14 of the shredder 10. In the case of a bin fill sensing device such as LED sensing device 72, the level at which the intensity is preferably set may be generally defined as a point at which the sensor detects an increase in capacitance with respect to accumulated shredded particles being discharged by the shredded mechanism. For example, in some cases, the level at which the intensity is preferably set may be generally defined as a point at which the sensor detects a minimum capacitance as a result of radiation being reflected off of the accumulated shredded particles in the bin, or reflected off of the bin itself.

In some cases, the level at which the intensity is preferably set for any of the sensing devices may be generally defined as a point determined by the controller 56 using rules, logic, computer readable medium, and/or software. The controller 56, therefore, is enabled to modify the intensity of the radiation or light emitted having specific regard to the current light output, desired light output, and variations in light output.

In an embodiment, the controller 56 may adjust the intensity of radiation by adjusting the LED sensing devices 50, 72 such that they are calibrated to a point at or within a predetermined amount of a minimum threshold detection level. The LED may be calibrated or modulated to determine the minimum level of intensity of radiation, such as via pulse-width modulation (PWM), for example. Therefore, the controller 56 may be used to assist in providing the desired level of intensity.

The cycle or method of FIG. 7 allows for compensation of component aging, slight misalignments, variances in component tolerances, and different component grades, as such features become less relevant for emitting and detecting the light beam by the sensor 50 or sensing device 72. Also, calibrating the sensing device(s) 50 and/or 72 aids in substantially eliminating the possible issue of overpowering the drive signal to the point that the sensor 50 would not communicate with controller 56 to activate the shredder mechanism 20 when needed. For example, when a single article (e.g., piece of paper) is inserted into the throat, sensor 50 may communicate with controller 56 to activate the shredder mechanism 20, or, alternatively, sensing devices 72 would communicate with controller 56 to deactivate the shredder mechanism 20 when it is detected that the container 18 or bin is full of accumulated shredded particles.

The cycle or method of calibrating the sensors 50 and/or 72, such as the embodiment shown in FIG. 7, may be repeated at any time. For example, in some embodiments, the intensity of radiation of the sensors 50, 72 may be calibrated immediately or automatically after the shredder is powered on. In some embodiments, the calibration may be performed after a predetermined amount of inactivity of the shredder mechanism 20, during a sleep mode (e.g., when the shredder 10 limits the amount of power being sent to its components), immediately after a shred operation, or before, during, or after other operations.

Figure 8:
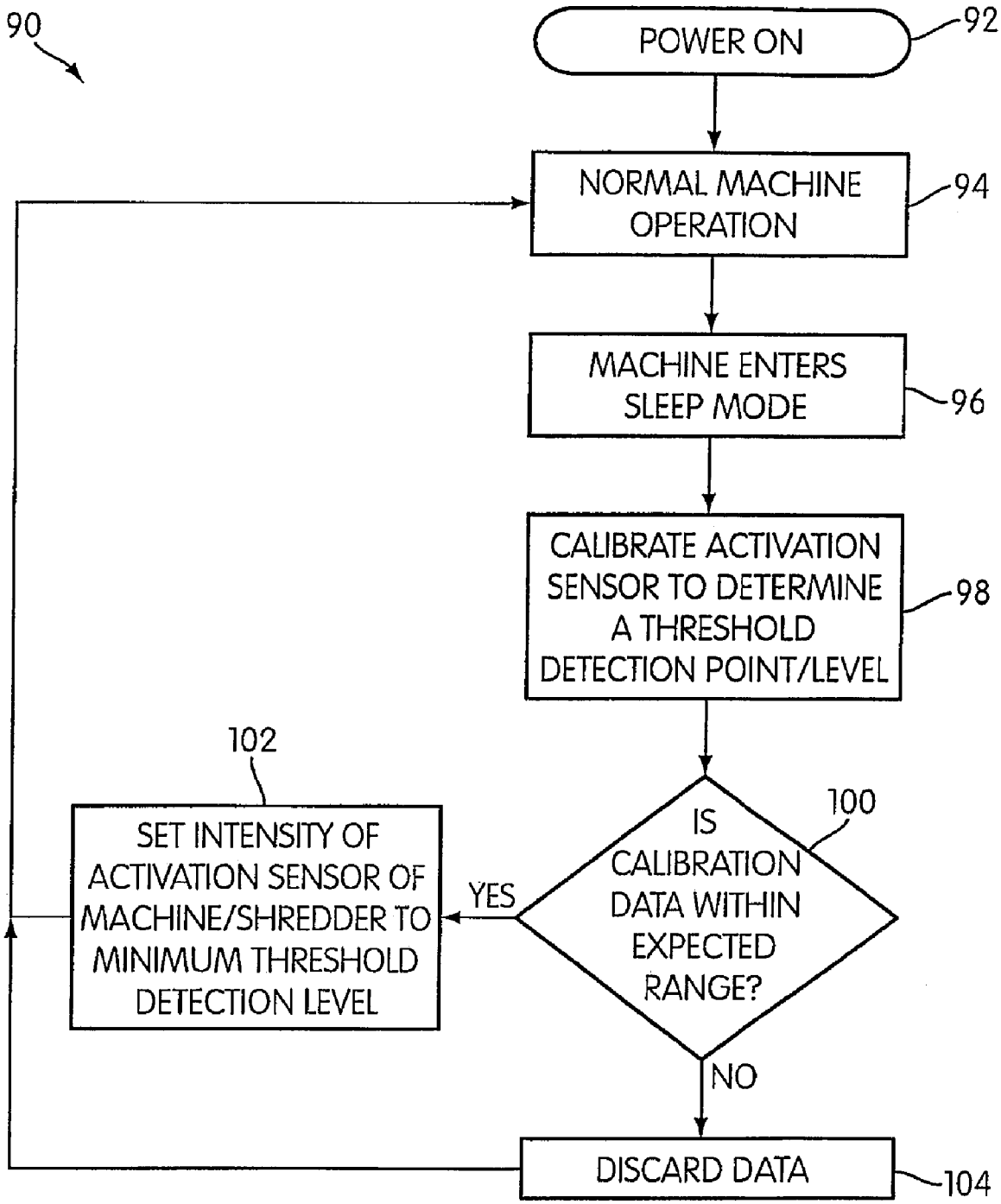
FIG. 8 illustrates a flow chart diagram illustrating a method of determining the need to perform a calibration of an activation sensor.

FIG. 8 illustrates an example of a flow chart diagram illustrating a method 90 of determining the need to perform a calibration of an activation sensor 50. After powering on at 92, normal machine operation(s) may be performed, as indicated at 94. At 96, the machine or shredder enters into a sleep mode. At 98, the activation sensor 50 is calibrated to determine a threshold detection point or level. Then, the calibration data is analyzed to determine if it is within an expected range at 100. If the calibration data is within an expected range, i.e., Yes, the activation sensor 50 is calibrated and set to a minimum threshold detection level, as indicated at 102, and normal machine operations may resume, as indicated at 94. If the calibration data is not within an expected range, i.e., No, the detection point/level and data determined at 98 is discarded at 104 and normal machine operations may resume, as indicated at 94, until another event for possible calibration is determined.

Figure 9:
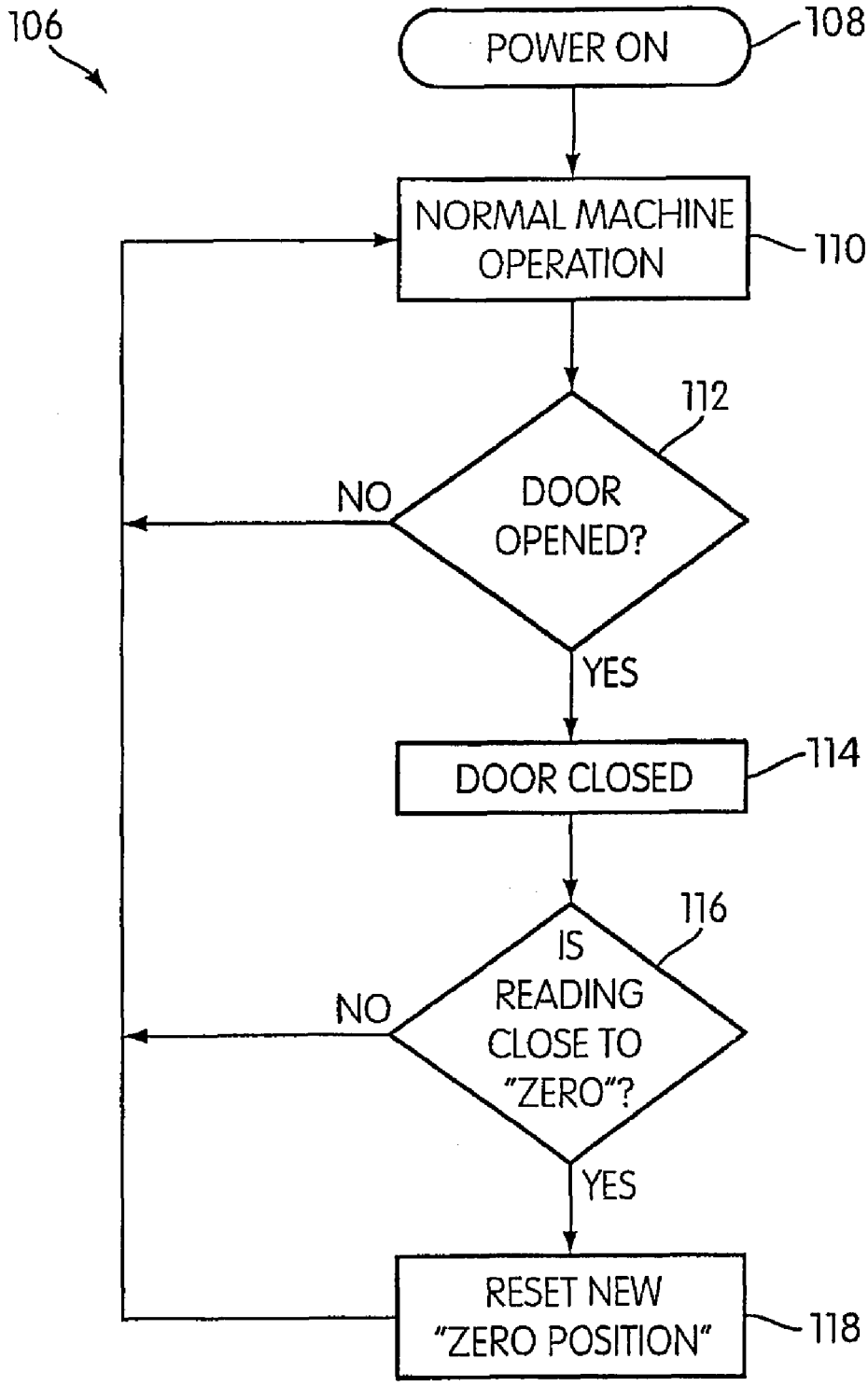
FIG. 9 illustrates a flow chart diagram illustrating a method of determining the need to perform a calibration of a bin full or waste level sensor.

FIG. 9 illustrates a flow chart diagram illustrating a method 106 of determining the need to perform a calibration of a bin full or waste level sensor 72, for example. After powering on the shredder at 108, normal machine operation(s) may be performed, as indicated at 110. At 112, the machine or shredder determines if a door to the container is opened (or other similar action that separates or stops operation of the motor, for example). If the door is not opened (or that other similar action is not detected), i.e., No, normal machine operations continue at 110. If it is determined that the door is opened (or that other similar action has occurred), i.e., Yes, the method 106 waits until it is determined that the door is closed, as indicated at 114 (or some other action is performed that satisfies the door open or other similar action). At 116, it is determined if the intensity reading of the bin full sensor 72 is close to a zero position or value. If the position is close to a zero position, i.e., Yes (and most likely no particles are present in the bin or container), the calibration is performed and the intensity of the radiation is set to a new zero position, as indicated at 116. Alternatively, if the reading is not close to a zero position, i.e., No (and most likely particles are present in the bin or container), normal machine operations of the shredder resume, as indicated at 110.

Additionally, it is envisioned that the controller 56 may comprise program code of machine or processor executable instructions in a memory that, when executed, instructs the controller to operate the shredder 10 and calibrate or recalibrate the drive signal of the activation sensor 50 or bin full sensing device 72 when appropriate.

In some embodiments, if an external event occurs that requires action, the calibration cycle or method can be aborted and the required action for the external event can be performed. For example, the shredder 10 (and its parts, e.g., additional sensors and controller 56) may detect a user's hands/fingers within a proximity of the throat 14, detect input on a user interface or display screen, detect paper thickness, or other events, and thereby override the calibration of the sensors 50, 72 until a next opportunity.

In some instances, the controller 56 may also determine whether the intensity of the sensor is less than (or more than) its previous zero position and requires calibration. If the controller 56 determines that the sensor signal is different than the previously noted zero position, the controller 56 recalibrates the sensor. Generally, the sensors may be calibrated or recalibrated for any number of discrepancies that are found between the zero position and a newly determined position as needed. In some instances, the controller 56 uses rules, logic, and/or software to determine if calibration or recalibration is required. For example, if a first sensor reading determines that a container 18 is substantially empty, yet after a short period of time a second sensor reading determines that the container 18 is substantially full, such logic may be used to note that based on the number of articles that were shredded, the container 18 is most likely not full and thus a false reading has been made. The intensity of the sensor may then be recalibrated to the most recent zero position, or, alternatively, recalibrated after operation of the shredder mechanism, for example. Additional examples of using logic, codes, etc. are described in further detail below.

The intensity of a single device or LED is provided at a base line voltage. The base line voltage comprises at least a value used to determine a first or starting intensity of radiation being emitted and detected. The base line voltage of a sensor is provided at a zero position by the controller 56. Over time, the radiation emitted by LEDs decreases in intensity. According to an embodiment, controller 56 automatically calibrates the intensity of the radiation of a sensor by adjusting the base line voltage to a second intensity.

When using LEDs as activation sensors 50 and/or bin full sensors 72, the LEDs may be calibrated in a similar manner as noted above. For example, when a plurality of LEDs are provided as bin full sensing devices 72 on the shredder housing 12, logic may be used to determine false positive readings. After an operation, should a first LED determine a 10% higher reading than a second LED, the controller 56 may use such logic to determine calibration is needed, since such a difference in detection of accumulated shredded particles is not likely.

In addition to preventing false positive signals being sent from the controller 56 to the shredder mechanism 20, calibrating the LEDs may also increase the life the sensors 50 and/or 72 by keeping it the emission of radiation within a range related to the changes in the intensity of light emitted by the LEDs. In addition, using the controller 56 to calibrate LEDs, for example, may be beneficial to distinguish between false errors or the need to recalibrate the sensor to a new zero position. As previously noted, if the controller 56 determines that the sensor signal is less than the previously noted zero position, the controller 56 recalibrates the sensor. In some instances, however, the controller 56 may ignore any offset in the intensity as an error, such as when dust or shredded particles temporarily alter the intensity of the radiation. In some embodiments, the controller may determine an offset and adjust the intensity for the operation or a predetermined period of time before defaulting back to the previous zero position. Also, the controller 56 may be equipped to determine that, after a plurality of adjustments, the intensity of the radiation should be recalibrated.

More specifically, for example, the controller 56 and/or logic, codes, software, computer readable medium, etc., may be used to calibrate a sensor after detecting an emptying process. For example, if the sensing device 72 determines that a bin is full of accumulated particles, the user may empty the bin 18. Additional sensors and/or logic may determine, for example, one or more events that indicate a possible emptying process, including, but not limited to: movement of the container 18, moving the container 18 with respect to or relative to a frame, opening of a frame door, separation of the shredder housing 12 and bin 18, etc. Thereafter, the sensing device 72 may be calibrated. If it is determined that the sensor reading is close to or substantially near the previous zero position, the controller 56 assumes the bin or container 18 has been emptied, and may set the threshold detection level substantially equal to the sensor reading. In some instances, if the sensor reading is not substantially equal to the threshold detection level of the previous zero position, but within a predetermined amount (e.g., a 2% difference), logic may be used to null the intensity or base line voltage to the previous zero position. For example, it may be assumed that such a slight difference is due to dust or small particles. Additionally or alternatively, a substantially large change in a sensor's first and second readings may be determined to indicate an emptying process. The second reading, therefore, may be used to set a new zero position for the base line voltage and therefore the intensity for determining the waste level of the bin 18.

In some instances, the controller 56 may determine that a detected intensity is not accurate and that the sensing device 72 must be calibrated based on previous sensor readings, intensity values stored in memory, etc. For example, once sensing device 72 is calibrated after an emptying process, it may be determined that the second sensor reading is higher than a predetermined amount, or, alternatively, substantially different from a first reading (e.g., 20% difference). Because the controller 56 has determined that an emptying process has occurred, the controller 56 may also determine an approximate outcome for the second sensor reading. That is, the approximate intensity of the reflected radiation after emptying the container 18 is generally known. When such a difference is determined between a first and a second reading, the difference in the first and second readings may be measured to determine if such the second reading is accurate, or, alternatively, mistakenly due to dust and/or other particles. If the reading is determined to be accurate, the sensing device 72 is calibrated to the value determined by the second reading. If the reading is determined to be incorrect, the sensing device 72 is calibrated to the previous or a default base line voltage/zero position.

In some embodiments, calibration may occur during the emptying process. For example, if controller 56 communicates with a sensor that detects the container 18 is separated from shredder housing 12 (or some other similar action for emptying as noted above), controller 56 may calibrate the sensing device 72. Calibrating the sensing device 72 during such a process is beneficial as the intensity will be set when no shredded particles are in the container 18, or near there. In particular, in an embodiment where bin or container 18 may be removed from a frame (e.g., sliding like a drawer therefrom), the base line voltage or intensity setting for sensing device 72 may be determined based on detecting reflected radiation within the empty frame. That is, when the container 18 is substantially removed from the frame, the base line voltage of the sensing device 72 may be adjusted to determine a threshold detection level for the intensity. Also, in some embodiments, after replacement of the container 18, should a reading differ from a reading acquired when the container 18 was substantially removed from the frame during the emptying process, controller 56 may estimate or determine if the reading is accurate, and, if necessary, approximate an amount of dust and/or particles that may be present in the container 18.

Of course, sensing device 50 may be calibrated and/or re-calibrated in such similar manners.

Other advantages of using LEDs as sensing devices 50 or 72, for example, include their ability to be calibrated to any desired zero point. In some instances, the threshold detection level of sensing devices 50 or 72 may be set by a user or manufacturer. For example, should a user find that the bin 18 becomes too full of shredded particles before a warning is issued or the shredding process is stopped, the user may optionally manually override the default settings and the controller's 56 actions by setting or adjusting the threshold detection point of sensor 72.

It should be noted that the methods for determining the sensed actions (e.g., insertion of article or accumulation of materials) should not be limiting. For example, the controller and/or other hardware or software in the shredder 10 may estimate the amount of material being shredded. As shown in FIG. 3, one or more sensors 72 may be provided in or near the output opening 16, so as to detect shredded particles as they are deposited from the shredder mechanism 20. Such estimation(s) may be made based on time between detecting shredded particles using a timer, for example. Logic and/or other operations to estimate the amount of material in the bin 18 may also be used.

Additionally, a contact or mechanical member (not shown) may be provided that extends into the throat 14 and is actuated in response to the at least one article being inserted into the throat 14. In an embodiment, the contact or mechanical member (not shown) may be provided to assist in activating the operation of the shredder mechanism 20. Alternatively, the contact member (not shown) may be provided to assist in identifying or indicating the thickness of a stack of articles.

While the principles of the invention have been made clear in the illustrative embodiments set forth above, it will be apparent to those skilled in the art that various modifications may be made to the structure, arrangement, proportion, elements, materials, and components used in the practice of the invention.

The type of shredder 10 that capturing device is applied to should not be limiting. For example, the capturing device may be applied to shredders comprising lift-off shredder housings. Also, the shredder 10 may comprise a shredder mechanism 20 and cutter elements 21 many configurations. The above mechanism may be implemented in all cross cut machines and strip cutting machines.

Additionally, one or more sensors 50 and/or 72 may be used in cooperation with one or more other sensor devices in the shredder 10. Such sensor devices may be devices that are capable of, but not limited to, determining a maximum thickness (e.g., to indicate that the thickness of at least one article being inserted into the throat 14 is at least equal to a predetermined thickness), detecting movement of the container 18, detecting shredded materials located in or around the output opening 16, detecting power of the shredder 10 or whether the shredder mechanism 20 is switched on or off, and/or detecting and indicating that the output opening 16 is restricted or closed. Also, sensor devices may be used in cooperation with any number of mechanical, electromechanical, or electric devices. For example, in the case of a sensor for detecting movement of the container, if the waste container or bin 18 is removed from the shredder housing 12, the shredder mechanism 20 will not operate.

Additionally, it is envisioned that the method of calibration as described herein may be used with any of type of LED sensor provided with a shredder. Also, automatic calibration may be performed for any, some, or all of the LED sensors provided with the shredder.

In some embodiments, any number of visual or audible signals in the form of lights or alarms, for example, may be used in cooperation with the sensors and shredder. For example, it is envisioned that such signals may be used under circumstances such as indicating that the bin is full. Any suitable indicator may be used.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into shredded particles;

at least one light-emitting diode being operable as a sensor, the at least one light-emitting diode sensor configured to be used as an emitter when operated in a forward-biased direction and configured to be used as a detector when operated in a reverse-biased direction;

a controller coupled to the sensor and the shredder mechanism, the controller being configured to alternate an input to the light-emitting diode between the forward-biased and reverse-biased directions, and the controller being operable to control an operation of the shredder mechanism based upon the radiation detected by the sensor.

2. The shredder according to claim 1, the sensor being selected from one of the group consisting of (a) a throat sensor operable to detect insertion of the at least one article into the throat based on a change in the radiation detected by the sensor, and (b) a waste level sensor operable to detect an accumulation of shredded particles discharged by the shredder mechanism based on a change in the radiation detected by the sensor.

3. The shredder according to claim 2, wherein the shredder comprises a throat sensor and a waste level sensor, and wherein the controller is coupled to the sensors.

4. The shredder according to claim 1, wherein the shredder housing has a bottom wall with an output opening thereon, and wherein the light-emitting diode is mounted to the bottom wall.

5. The shredder according to claim 1, wherein the radiation emitted by the light-emitting diode is selected from the group consisting of: light in the visible spectrum, infrared radiation, and ultraviolet radiation.

6. The shredder according to claim 1, wherein the motor rotates the cutter elements in an interleaving relationship for shredding articles fed therein through the input opening.

7. The shredder according to claim 1, further comprising a container for receiving the at least one shredded article or shredded particles.

8. The shredder according to claim 7, wherein the at least one light-emitting diode is provided on or adjacent the container.

9. The shredder according to claim 2, wherein the controller is configured to perform an automatic calibration of the at least one light-emitting diode, wherein an intensity of the radiation emitted by the at least one light-emitting diode is adjusted to or within a predetermined amount above a minimum threshold detection level when no article or shredded particles is/are present to change the radiation detected the sensor.

10. The shredder according to claim 9, wherein the calibration is performed after operation of the shredder mechanism.

11. The shredder according to claim 1, wherein the radiation detected by the sensor is determined based upon a change in capacitance detected by the at least one light-emitting diode.

12. The shredder according to claim 1, wherein a plurality of light-emitting diodes are provided and operable as the sensor, and wherein the plurality of light-emitting diodes are mounted in an array on the housing.

13. The shredder according to claim 1, wherein the radiation emitted by the light-emitting diode is in the visible light spectrum, and wherein the sensor is a throat sensor operable to detect insertion of the at least one article based on a change in the radiation detected by the sensor, wherein the sensor is mounted at the throat so at least a portion thereof is viewable externally of the shredder such that alternating the input to the light-emitting diode causes the diode to act as a user indicator in the forward-biased direction, while also functioning as a detector in the reverse-biased direction that detects insertion of the at least one article based on a change in ambient light radiation.

14. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

a container for receiving shredded particles;

a series of light-emitting diodes positioned to receive radiation reflected off of the shredded particles deposited in the container and determine an intensity of the reflected radiation, the intensity corresponding to an amount of shredded particles deposited in the bin;

the series of light-emitting diodes configured to be used as emitters when operated in a forward-biased direction and configured to be used as detectors when operated in a reverse-biased direction;

a controller coupled to the series of light-emitting diodes and the shredder mechanism, the controller being configured to alternate an input to the series of light-emitting diodes between the forward-bias and reverse-biased directions, and the controller being operable to control an operation of the shredder mechanism upon detection by the sensor.

15. The shredder according to claim 14, the controller being configured to adjust the intensity of the radiation received by the light-emitting diodes to or within a predetermined amount at or above a minimum threshold detection level when a condition of the shredder is satisfied.

16. The shredder according to claim 15, wherein the condition is defined by movement of the container relative to the shredder housing.

17. The shredder according to claim 14, wherein the shredder housing has a bottom wall and the series of light-emitting diodes is mounted to the bottom wall to detect shredded particles in the container.

18. The shredder according to claim 15, wherein the adjusting of the intensity is performed after operation of the shredder mechanism.

19. The shredder according to claim 14, wherein the intensity of the radiation is determined based upon a change in capacitance detected by the series of light-emitting diodes.

20. The shredder according to claim 14, wherein the series of light-emitting diodes is mounted to the housing in an array.

21. A method performed in a shredder comprising a shredder housing having a throat for receiving at least one article to be shredded therethrough; a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into shredded particles; at least one light-emitting diode being operable as a sensor, the at least one light-emitting diode sensor configured to be used as an emitter when operated in a forward-biased direction and configured to be used as a detector when operated in a reverse-biased direction; a controller coupled to the sensor and the shredder mechanism, the controller being configured to alternate an input to the light-emitting diode between the forward-biased and reverse-biased directions, and the controller being operable to control an operation of the shredder mechanism based upon the radiation detected by the sensor, wherein the method comprises:

alternating the input to the light emitting diode between the forward-biased and reverse-biased directions;

detecting radiation with the light-emitting diode; and controlling, with the controller, an operation of the shredder mechanism based upon the radiation detected by the light-emitting diode.

* * * * *